United States Patent [19]

Lovato

[11] Patent Number: 4,569,106

[45] Date of Patent: Feb. 11, 1986

[54] BUCKLE OF THE SNAP CLOSURE TYPE HAVING THE TWO PARTS ENGAGEABLE BY SNAP ACTION IDENTICAL TO ONE ANOTHER

[75] Inventor: Attilio Lovato, Pino Torinese, Italy

[73] Assignee: ITW Fastex Italia S.p.A., Turin, Italy

[21] Appl. No.: 750,662

[22] Filed: Jul. 1, 1985

Related U.S. Application Data

[63] Continuation of Ser. No. 476,100, Mar. 17, 1983, abandoned.

[30] Foreign Application Priority Data

Mar. 19, 1982 [IT] Italy ..... 20273 A/82

[51] Int. Cl.[4] ..... A44B 11/25

[52] U.S. Cl. ..... 24/615; 24/575

[58] Field of Search ..... 24/614–616, 24/604, 459, 575, 576, 578

[56] References Cited

U.S. PATENT DOCUMENTS

| | | | |
|---|---|---|---|
| 2,406,895 | 9/1946 | Olson | 24/575 X |
| 3,520,033 | 7/1970 | Usuda | 24/575 |
| 3,979,801 | 9/1976 | Tareau | 24/575 |
| 4,052,774 | 10/1977 | Noda | 24/575 |
| 4,150,464 | 4/1979 | Tracy | 24/615 |

*Primary Examiner*—Philip C. Kannan

*Attorney, Agent, or Firm*—Trexler, Bushnell & Wolters

[57] ABSTRACT

A buckle of the snap closure type consists of two identical parts, each of which has a male member and a female member. The male member of the one part is adapted to engage by snap action the female member of the other part. The fact that the two parts forming the buckle are identical substantially simplifies both the manufacturing of said parts and their storage.

3 Claims, 5 Drawing Figures

BUCKLE OF THE SNAP CLOSURE TYPE HAVING THE TWO PARTS ENGAGEABLE BY SNAP ACTION IDENTICAL TO ONE ANOTHER

This application is a continuation of application Ser. No. 476,100, filed Mar. 17, 1983, now abandoned.

The present invention relates to buckles of the snap closure type.

BACKGROUND OF THE INVENTION

The prior art buckles consist normally of a male part adapted to engage a female part. Therefore, two different molds are required for manufacturing said buckles, the one for the male part and the other for the female part.

A buckle of this type is described in the Italian patent application No. 26472 A/78 filed on Aug. 4, 1978 to which reference is made for greater details.

SUMMARY OF THE INVENTION

It is the object of the present invention to provide a buckle of the snap closure type which is more simple and inexpensive to manufacture than the prior art buckles of this type.

More particularly, the snap closure type buckle according to the present invention is characterized in that it comprises two identical parts, each of which has a male member and a female member so that the male member of the one part is adapted to engage by snap action the female member of the other part.

This substantially simplifies both the manufacturing steps of the parts forming the buckle and their storage. It is namely sufficient to prepare a single mold for producing a single molded piece and to storage a single type of piece, with apparent advantages of simplicity of manufacture and low cost.

The invention will be better understood from the following detailed description, given merely by way of example and therefore in no limiting sense, of an embodiment thereof, referring to the accompanying drawings.

DESCRIPTION OF THE PREFERRED EMBODIMENT

Figure 1:
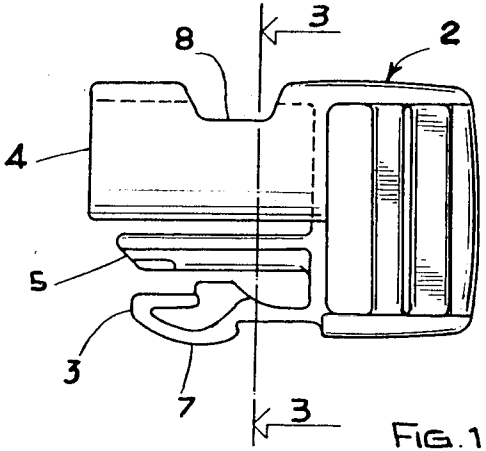
FIG. 1 is a front view of one of the two identical parts of the buckle according to the invention.
Figure 2:
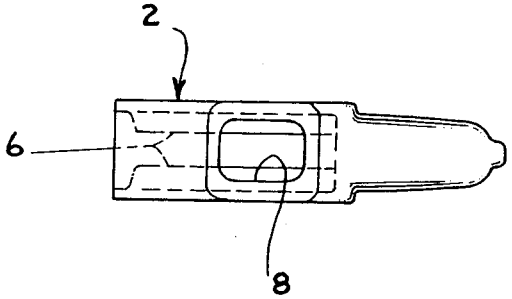
FIG. 2 is a top plan view thereof.
Figure 3:
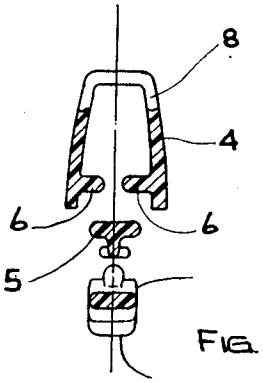
FIG. 3 is a transversal cross-section along the line 3—3 of FIG. 1.
Figure 5:
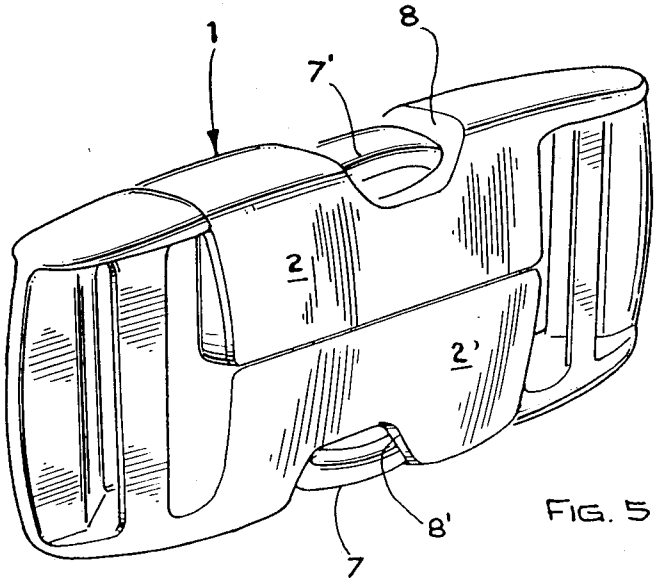
FIG. 5 is a perspective view of the buckle in closed condition.
Figure 4:
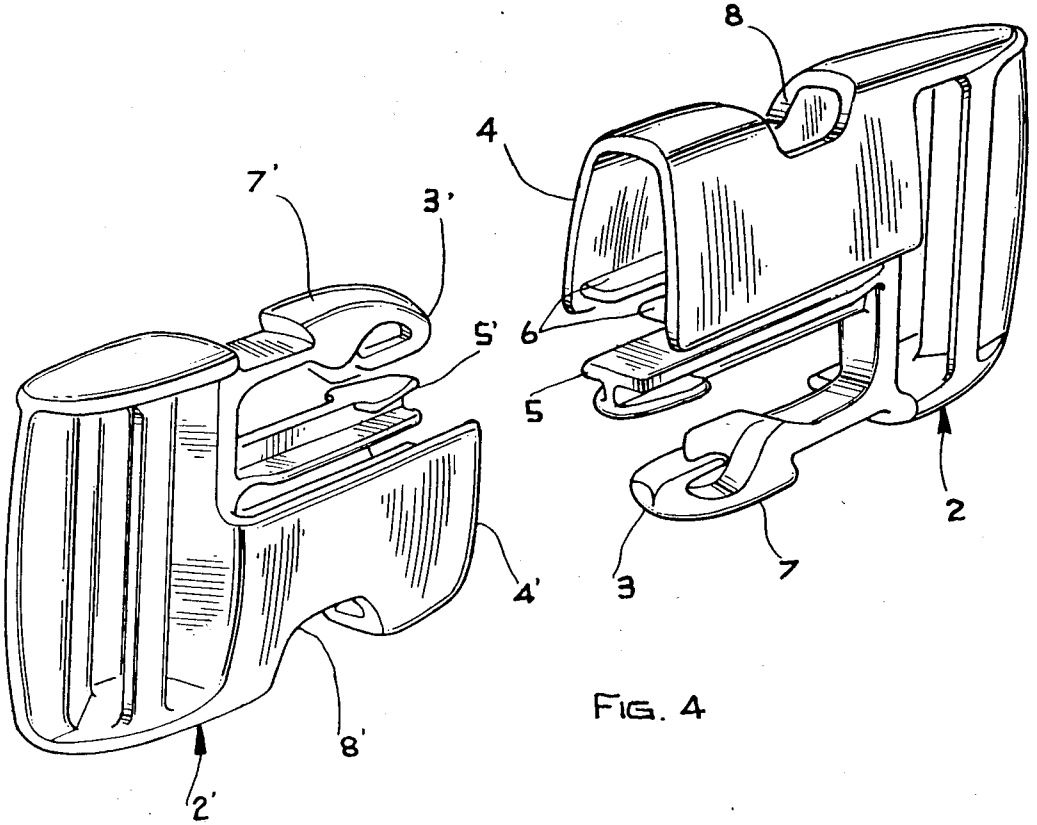
FIG. 4 is a perspective view of the two identical parts of the buckle ready to be hooked to one another.

From the figures it is seen that the buckle 1, of the snap closure type, consists of two identical parts 2, 2' and therefore it will be sufficient to describe only one of them.

The part 2 comprises simultaneously a flexible male member 3 and a female member 4. The male member 3 is formed in a manner so that it can deflect inwardly towards arm 5 and yet is biased outwardly so that it can hook by snap action. The female member 4' of the other part 2' forming the buckle includes a bounded chamber having a lateral opening 8' for receiving a portion 7 of the male member 3 which is also projecting laterally.

With the buckle in closed condition the portion 7 is engaged and restrained in slot 8' provided in the female member 4' thereby securing the two buckle parts together.

Each part 2, 2' comprises, in addition, guide elements, more particularly a rather rigid male guide element 5, adapted to engage a female guide element (identical to element 6 of part 2) of the part 2' and a male guide element 5' adapted to engage a female guide element 6 of the part 2.

Each part 2, 2' has, in addition, at its inner end means to secure each part 2 of the buckle to an end of a strip shaped member, the buckle having precisely the function to connect said two ends.

In order to hook by a snap action the two parts 2, 2' of the buckle 1 the two identical parts 2, 2' of the buckle 1 must be positioned so that the female member 4' of the part 2' corresponds to the male member 3 of the part 2 and the female member 4 of the part 2 corresponds to the male member 3' of the part 2'. It is finally sufficient to press the two parts 2,2' against one another so that a snap engagement of the male members 3, 3' with the corresponding female members 4, 4' takes place.

In order to disconnect the parts 2, 2' and thus open the buckle 1, it will be sufficient to press on the portions 7, 7' of each male member 3, 3' respectively, said portions 7, 7' projecting from the slots 8', 8 respectively of the associated female members 4', 4 so as to deflect the male members 3, 3' inwardly and to disengage the portions 7', 7 from slots 8', 8, respectively, and thereby disconnect them from the corresponding female members 4', 4.

The materials of which the buckle can be made are those typical for snap closure buckles, such as for example nylon or acetal resins.

While but one embodiment of the invention has been illustrated and described, it is obvious that a number of modifications and changes can be made without departing from the scope of the invention.

I claim:

1. A buckle of the snap closure type, said buckle having two identical parts of generally rectangular configuration, each part including securement means at one end thereof for securing the part to one end of a strap or the like; a male member and a female member extending axially from the opposite end of each part in laterally spaced substantially parallel and overlapping relation along opposite sides of said rectangular configuration; said male member of each said part including a flexible arm member having a laterally outwardly projecting portion and said female member of each said part including a laterally disposed opening adapted to receive the laterally projecting portion of the arm member received therein, so that the male member of each part is adapted to be axially telescoped into the female member of the other part, each said female member including an elongated chamber open at least at said opposite end of each part and having said lateral opening in the wall thereof for receiving by snap action the projecting portion carried by said flexible arm member; and an axially extending guide element extending from said opposite end of each part and disposed between said arm member and said female member; each said female part including guide means extending lengthwise of said chamber and complementary to said guide element and spaced inwardly from said laterally disposed opening for cooperative sliding engagement with the guide element of the other part during telescopic association of the parts without interference with the flexible arm member and laterally extending projection of the other part.

2. A buckle as set forth in claim 1 wherein the guide means of each part is disposed within the chamber of the female member of the corresponding part in spaced clearance of the flexible arm and projecting portion of the other part.

3. A buckle as set forth in claim 1 wherein said projecting portions can be manually depressed through said lateral openings to disengage same and permit separation of the identical part of said buckle.

* * * * *